United States Patent [19]

Kozuki et al.

[11] 4,440,056

[45] Apr. 3, 1984

[54] ENVELOPE WAVE SHAPE SIGNAL GENERATOR FOR AN ELECTRONIC MUSICAL INSTRUMENT

[75] Inventors: Koichi Kozuki; Akira Nakada; Shigeru Yamada, all of Shizuoka, Japan

[73] Assignee: Nippon Gakki Seizo Kabushiki Kaisha, Japan

[21] Appl. No.: 359,117

[22] Filed: Mar. 17, 1982

Related U.S. Application Data

[63] Continuation of Ser. No. 158,917, Jun. 12, 1980.

[30] Foreign Application Priority Data

Jun. 15, 1979 [JP] Japan ..... 54-76172

[51] Int. Cl.[3] ..... G10H 1/02

[52] U.S. Cl. ..... 84/1.26; 84/1.13; 84/1.1

[58] Field of Search ..... 84/1.01, 1.26, 1.1, 84/1.13

[56] References Cited

U.S. PATENT DOCUMENTS

| | | | |
|---|---|---|---|
| 3,842,702 | 10/1974 | Tsunoo | 84/1.01 |
| 4,033,219 | 7/1977 | Deutsch | 84/1.26 |
| 4,067,253 | 1/1978 | Wheelwright et al. | 84/1.26 |
| 4,079,650 | 3/1978 | Deutsch et al. | 84/1.26 |
| 4,109,208 | 8/1978 | Tomisawa et al. | 328/14 |
| 4,201,109 | 5/1980 | Kitagawa | 84/1.26 |

*Primary Examiner*—Forester W. Isen

*Attorney, Agent, or Firm*—Lerner, David, Littenberg, Krumholz & Mentlik

[57] ABSTRACT

An envelope wave shape for each musical tone wave shape is generated per each key operation. The rate of change of the envelope wave shape to be generated are switched at timings corresponding to key operation speed of an operated key, thereby enabling an electronic musical instrument to generate musical tones of different envelope patterns depending on key operation speed just like on a pipe organ.

11 Claims, 3 Drawing Figures

ENVELOPE WAVE SHAPE SIGNAL GENERATOR FOR AN ELECTRONIC MUSICAL INSTRUMENT

This is a continuation of application Ser. No. 158,917, filed June 12, 1980.

BACKGROUND OF THE INVENTION

The present invention relates to an envelope wave shape signal generator for an electronic musical instrument, and more particularly relates to a generator, for an electronic musical instrument, capable of generating envelope wave shape signals with change in wave shape pattern in accordance with a key operating speed including key depressing and key releasing speeds.

On a pipe organ, for example, opening and closing speeds of a valve for each key change depending on the key operating speed. When the key is depressed slowly, gradual rise in musical tone generation gives a musical tone of a soft touch. Whereas, when the key is depressed quickly, abrupt rise in musical tone generation gives a musical tone of a sharp touch. Thus, on a musical instrument such as a pipe organ, the envelope patterns of generated musical tones change depending on the key operating speed.

SUMMARY OF THE INVENTION

It is the object of the present invention to provide a generator capable, on an electronic musical instrument, of generating envelope wave shape signals in accordance with key operation speed in a manner just like musical tone generation carried out on a musical instrument such as a pipe organ.

In accordance with the present invention, the rate of change in envelope wave shape signal to be generated is switched at a timing corresponding to the practiced key operating speed. Different key operating speeds cause different timings in switching, thereby changing wave shape patterns of envelope wave shape signals to be generated. Consequently envelop wave shape signals vary in pattern in accordance with change in practiced key operation.

DESCRIPTION OF THE PREFERRED EMBODIMENT

Figure 1:
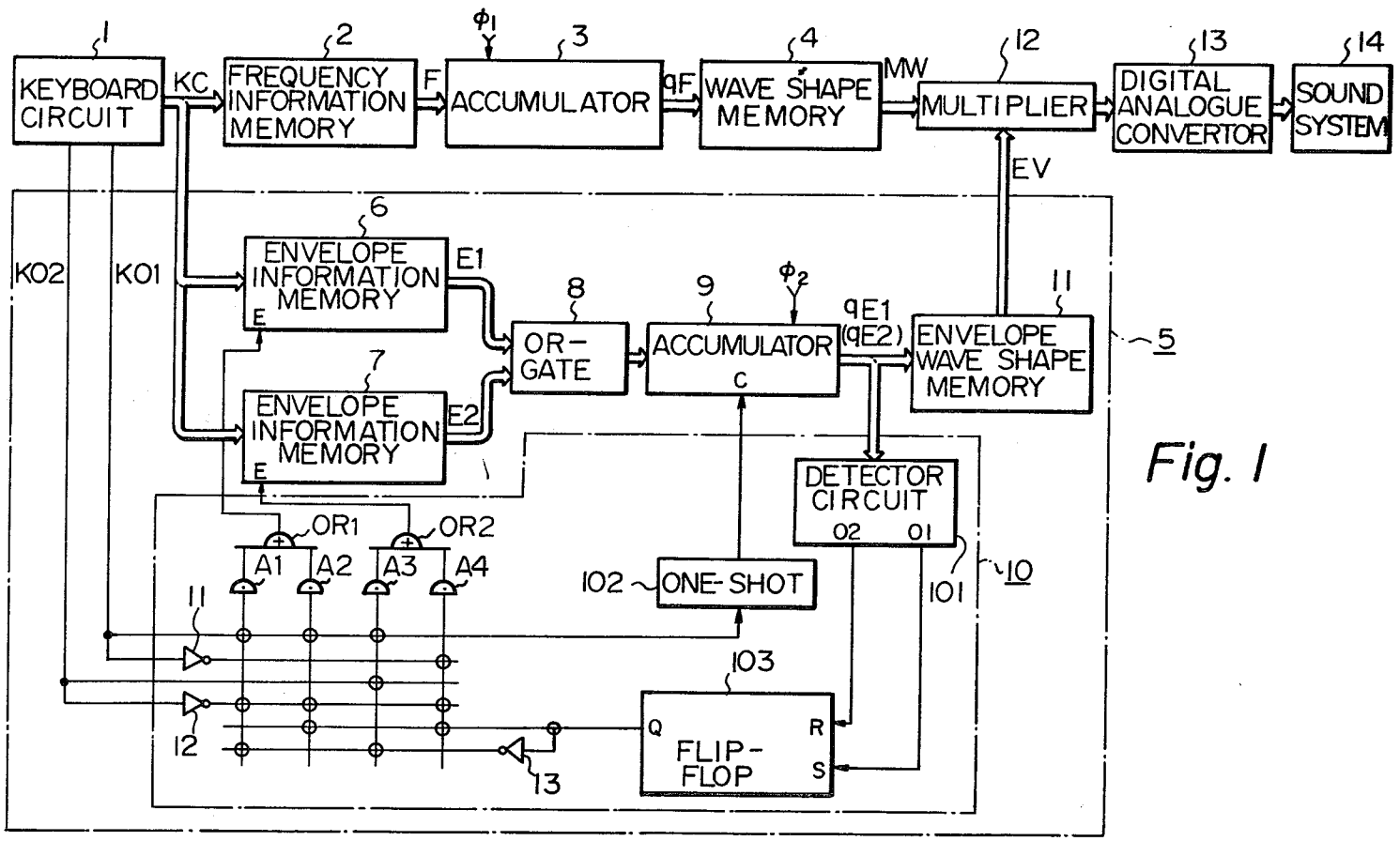
FIG. 1 is a block diagram of one embodiment of the generator in accordance with the present invention.

One embodiment of the generator in accordance with the present invention is shown in FIG. 1, which includes a keyboard circuit 1. This keyboard circuit 1 includes two sets of different key switches for each key arranged in the keyboard of an electronic musical instrument. One of the key switches say the first key switch, turns on simultaneously with starting of key depression. Whereas another of the key switches say the second key switch, turns on when key depression has reached a certain extent.

When the first key switch is "on," the keyboard circuit 1 generates the first key-on signal K01 and, when the second key switch is "on," the circuit 1 generates the second key-on signal K02. Difference in generation or degeneration timing between the first and second key-on signals K01 and K02 corresponds to the key depressing or releasing speed, respectively. The key-on signals K01 and K02 are both passed to a control circuit 10 provided within an envelope wave shape signal generating circuit 5 connected to the output side of the keyboard circuit 1.

The keyboard 1 further generates a key-code signal KC corresponding to the depressed key when the first key switch is activated. The key-code signal KC is passed to a frequency information memory 2 connected to the output side of the keyboard circuit 1. The key-code signal KC is further passed to envelope information memories 6 and 7 in the envelope wave shape signal generating circuit 5. The construction and operation of the above-described keyboard circuit 1 is a known art made open to public by, for example, Japanese Patent Preliminary Publication No. Sho. 53-13952.

The frequency information memory 2 stores frequency information values F, each corresponding to each key in the keyboard. Upon receipt of each key-code signal KC from the keyboard circuit 1, the memory 2 generates a frequency information value F corresponding to the depressed key. The frequency information values F are passed to an accumulator 3 connected to the output side of the frequency information memory 2. A series of clock pulse signals $\emptyset_1$ are periodically given to the accumulator 3 so that the frequency information values F taken from the frequency information memory 2 are accumulated sequentially by the accumulators upon each supply of the clock pulse signals $\emptyset_1$. Accumulated values qF (q=1, 2, 3 ---) are passed, as address signals, to a wave shape memory 4 connected to the output side of the accumulator 3. As a result of this reading-out by each address signal qF, the wave shape memory 4 generates a musical tone wave shape signal MW having a frequency corresponding to the depressed key.

Upon receipt of the first and second key-on signals K01, K02 and the key-code signal KC taken from the keyboard circuit 1, the envelope wave shape signal generating circuit 5 operates in the following manner. Envelope information values E1, E2 for each key or tone range are stored at the envelope information memories 6 and 7 in the generating circuit 5, respectively.

Figure 2:
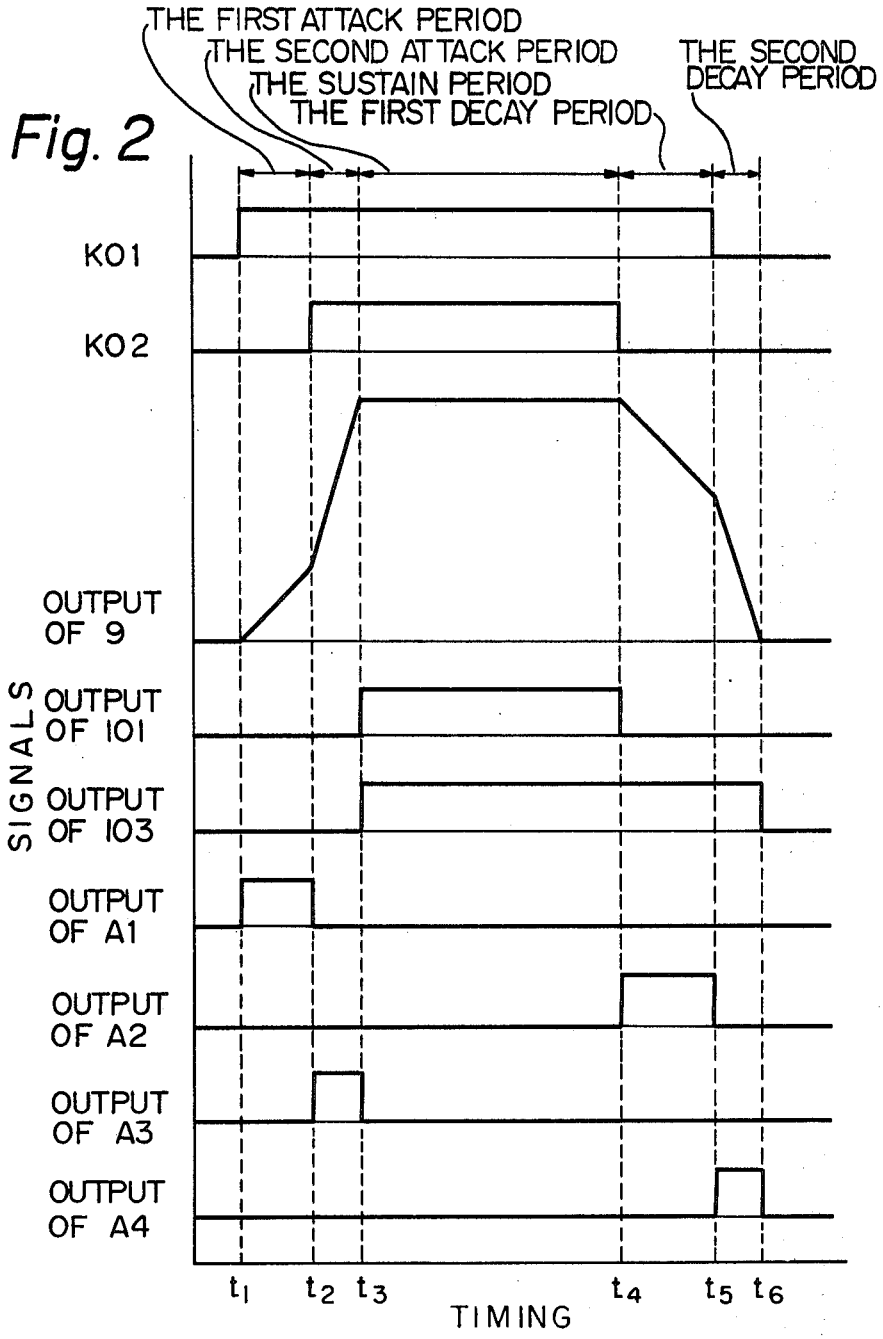
FIG. 2 is a timing chart for operation of the generator shown in FIG. 1.

Assuming that depressing of such and such a key in the keyboard is started at a timing $t_1$ in FIG. 2, the first key switch in the keyboard circuit 1 turns on instantly and the first key-on signal K01 is generated in order to be passed to one-shot 102 in the control circuit 10. In synchronism with the initial rise in the first key-on signal K01, the one-shot 102 generates a pulse signal of a prescribed period. This pulse signal is passed to a clear terminal C of an accumulator 9 connected, via an OR-gate 8, to the output sides of the envelope information memories 6 and 7. Thereupon the accumulator 9 generates an accumulated value "0" which is then passed to a detector circuit 101 in the control circuit 10.

The detector circuit 101 is constructed so that it generates a logic value "1" at its output terminal 01 when the accumulated value from the accumulator 9 reaches a prescribed value N1, and a logic value "1" at its output terminal 02 when the accumulated value from the accumulator 9 reaches a prescribed value N2 which is equal to the last address value for a later described envelope wave shape memory 11.

Now the accumulated value from the accumulator 9 is equal to "0" and the detector circuit generates logic values "0" at the output terminals 01 and 02. The logic values "0" are passed to a reset terminal R and a set terminal S of a flip-flop 103 connected to the output side of the detector circuit 101. Then the flip-flop 103 is kept under the reset condition and a logic value "0" appears at its output terminal Q.

In the control circuit 10, an AND-gate A1 is connected directly to the first key switch in the keyboard circuit 1 which generates the first key-on signal K01 at the timing $t_1$, to the second key switch in the keyboard circuit 1, which generates no signal at the timing $t_1$, via an invertor 12, and to the output terminal Q of the flip-flop 103, which generates the logic value "0" at the timing $t_1$, via an invertor 13. Consequently, an AND-condition is established at the AND-gate A1 in the control circuit 10 at the timing $t_1$ and the AND-gate A1 generates a logic value "1" which is then passed to an enable terminal E of the envelope information memory 6 via an OR-gate OR1.

Figure 3:
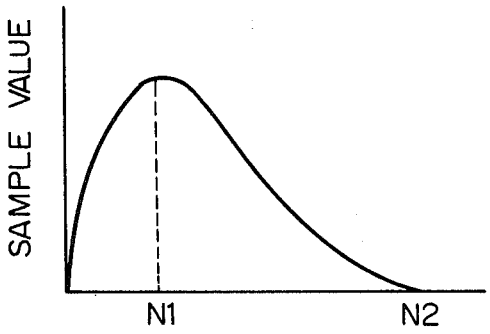
FIG. 3 is a graph for showing one example of the wave shape stored at the envelope wave shape memory used for the generator shown in FIG. 1.

Thus, the envelope information memory 6 is enabled to generate, at the timing $t_1$, an envelope information value E1 corresponding to the key-code signal KC of the depressed key. The envelope information values E1 are then passed to the accumulator 9 in order to be accumulated upon receipt of periodical clock pulse signals Ø2. Each accumulated value q.E1 (q=0, 1, 2 ---) is then passed to the envelope wave shape memory 11 as an address signal. Sample values of a wave shape shown in FIG. 3 are stored at addresses designated the address signal within the envelope wave shape memory 11 and read out sequentially according to the address signals q.E1. In the manner described, the envelope shape signal generator 5 generates envelope wave shape signal EV during the first attack period shown in FIG. 2.

At a timing $t_2$, the key is depressed deeper beyond a prescribed extent and the second key switch in the keyboard circuit 1 turns on now to generate the second key-on signal K02.

In the control circuit 10, an AND-gate A3 is directly connected to the second key switch in the keyboard circuit 1 whereas the AND-gate A1 is connected to the second key switch via an invertor 12. Consequently, an AND-condition is established at the AND-gate A3 due to the second key-on signal K02 taken from the keyboard circuit 1. In this case, however, no AND-condition is established at the AND-gate A1 since the second key-on signal K02 from the keyboard circuit 1 to the control circuit 10 is inverted into a logic value "0" by the invertor 12.

Thus, a logic value "1" from the AND-gate A3 is passed to an enable terminal E of the second envelope information memory 7 in order to enable the memory 7 to generate the envelope information value E2 corresponding to the key-code signal KC of the depressed key. The envelope information values E2 are then passed to the accumulator 9 for sequential accumulation upon receipt of the clock pulse signals Ø2. At this timing, the accumulated value qs·E1 obtained during the first attack period is still left in the accumulator 9, qs being the number of accumulation during the first attack period. Thus, the resultant accumulated value is equal to (qs·E1+q·E2), (q=0, 1, 2 --- ). Each accumulated value (qs·E1+q·E2) is passed to the envelope wave shape memory 11 as an address signal so that the memory 11 generates an envelope wave shape signal EV over the second attack period, which is continuous to the envelope wave shape signal generated during the first attack period.

Assuming that the accumulated value (qs·E1+q·E2) at the accumulator 9 reaches the address value N1 shown in FIG. 3 at a timing $t_3$, the detector circuit 101 detects this condition and generates a logic value "1" at its output terminal 01. This output is passed to the set terminal S of the flip-flop 103 which in turn generates a logic value "1" at its output terminal Q. Since this output is inverted into a logic value "0" by the invertor 13, no AND-condition is established at the AND-gate A3 at the timing $t_3$. Consequently, neither the first envelope information memory 6 nor the second envelope information memory 7 is enabled to generate any value. Consequently, the accumulated value remains constant whilst corresponding to the address value N1. As a result, the envelope wave shape signal EV to be generated over a sustain period in FIG. 3 is given in the form of sample value stored at the address N1 in the envelope wave shape memory 11. During this sustain period, the envelope wave shape signal EV remains constant.

As releasing of the hitherto depressed key starts at a timing $t_4$, the second key switch in the keyboard circuit 1 turns off and the second key-on signal K02 is no longer generated. At this timing, the first key-on signal K01 is still generated and the flip-flop 103 is maintained under the set condition.

In the control circuit 10, an AND-gate A2 is connected directly to the first key switch in the keyboard circuit 1, to the second key switch in the keyboard circuit via the invertor 12, and directly to the output terminal Q of the flip-flop 103 now generating a logic value "1." The logic value "0" from the second key switch is inverted into "1" by the invertor 12.

Thus, an AND-condition is established at the AND-gate A2 as the timing $t_4$ which thereupon generates a logic value "1." This logic value "1" is passed, via the OR-gate OR1, to the enable terminal of the first envelope memory 6 in order to enable the memory 6 to generate the envelope information value E1. Receiving the envelope information values E1, the accumulator 9 accumulates the values E1 and generates the accumulated values in order to pass them, as address signals, to the envelope wave shape memory 11. Upon receipt of each accumulated value, the memory 11 generates a sample value stored at a corresponding address to form an envelope wave shape signal EV for the first decay period in FIG. 2. Accumulation at the accumulator 9 in this instance starts continuously from a value next to the address value N1 shown in FIG. 3

As releasing of the hitherto depressed key further continues, the first key switch in the keyboard 1 turns off and the first key-on signal K01 is no longer generated.

In the control circuit 10, an AND-gate A4 is connected to the first key switch in the keyboard circuit 1 via the invertor 11, to the second key switch via the invertor 12, and directly to the output terminal Q of the flip-flop 103.

No AND-condition is established at the AND-gate A2 and, consequently, the first envelope information memory 6 is disabled to generate any value. Whereas an AND-condition is established at the AND-gate A4 since the second key-on signal K02 is no longer generated and the flip-flop 103 is kept under the set condition. As a consequence, a logic value "1" taken from the AND-gate A4 is passed to the enable terminal E of the envelope information memory 7 via the OR-gate OR2 in order to enable the memory 7 to generate envelope information values E2 as a substitute for the values E1 generated by the first envelope information memory 6 during the first decay period. The values E2 are accumulated at the accumulator 9 in order to generate address signals, i.e. accumulated values, for the envelope wave shape memory 11. Upon receipt of each address signal, the memory 11 generates a sample value in order to form an envelope wave shape signal for the second decay period in FIG. 2.

As the accumulated value at the accumulator 9 reaches the last address value N2 for the envelope wave shape memory 11, the detector circuit 101 in the control circuit 10 detects this condition and generates a logic value "1" at its second output terminal 02. Upon receipt of this signal at the reset terminal R, the flip-flop 103 is reset so that no AND-condition is established at the AND-gate A4, thereby disabling the envelope information memory 7 to generate any value. Thus, generation of the envelope wave shape signal EV ceases.

The patterns of the initial rise and last fall of the envelope wave shape signals EV vary from key to key, or from range to range, since envelope information values E1 and E2 taken from the memories 6 and 7 vary from key to key, or from range to range.

Each envelope wave shape signal EV taken from the envelope wave shape signal generating circuit 5 is multiplied, at a multiplier 12, by each corresponding musical tone wave shape signal MW taken from the wave shape memory 4 so that the musical tone wave shape signal MW is provided with a tone volume envelope corresponding to the envelope wave shape signal EV. The resultant signal is then passed to an digital-analogue convertor 13 for conversion into a corresponding analogue signal which is in turn passed to a sound system 14 for generation of a corresponding musical tone.

In accordance with the above-described embodiment of the generator of the present invention, quick key depressing causes early generation of the second key-on signal K02 and consequently, switching between the envelope information values E1 and E2 is carried out quickly. At a consequence, when the envelope information value E2 is set larger than the envelope information value E1, an envelope wave shape signal EV with quick rise is generated by the envelope wave shape memory 11 in order to generate a musical tone of a sharp touch. When key releasing is carried out quickly, an envelope wave shape signal EV with quick fall is generated.

On the contrary, slow key depressing causes delayed generation of the second key-on signal K02 and, consequently, switching between the envelope information values E1 and E2 is carried out slowly. As a result, an envelope wave shape signal EV with gradual rise is generated by the envelope wave shape memory 11 in order to generate a musical tone of a soft touch. Slow key releasing likewise causes generation of an envelope wave shape signal EV with gradual fall.

In the case of the above-described embodiment, switching between the envelope information values E1 and E2 is performed by means of enabling and disabling the envelope information memories 6 and 7. The shift from E1 to E2 results in a change in the rate of accumulation of the envelope address in accumulator 9 and produces, at the instant of change, a salient point in the envelope shape read from memory 11. As a substitute, it is also employable in the present invention to arrange gates on the output sides of the envelope information memories 6 and 7 and control operation of such gates using the outputs from the OR-gates OR1 and OR2.

In the case of the above-described embodiment further, switching between the envelope information values E1 and E2 is carried out both for the attack (rise) and decay (fall) periods. The switching, however, may be carried out for either of the two periods, with a slight obvious change in design of the control circuit 10.

Figure 4:
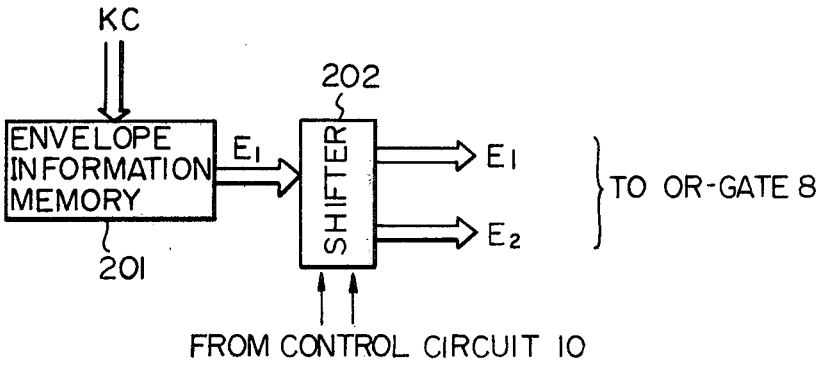

In a modification of the above-described embodiment, the envelope information memories 6 and 7 may be replaced by a circuit comprising an envelope information memory 201 and shifter 202 shown in FIG. 4.

That is, instead of selectively reading out E1 or E2 of from either of the envelope information memories depending on the given enable signal, the shifter in this embodiment practices one of the following three operations in response to E1 taken from one envelope information memory depending on the information from the control circuit, i.e. the output signal from the OR-gate OR1 or OR2. In the first operation, E1 is inhibited and the shifter gives no output. In the second operation, E1 is shifted by a specified bit number into E2 as an output. In the third operation, E1 is given by the shifter as an output without any change.

In a modification of the above-described embodiment, the envelope information memories 6 and 7 may be each replaced by an envelope clock pulse signal generator which generates clock pulse signals having a frequency corresponding to the key-code signal KC for a depressed key and operations of such envelope clock pulse signal generators may be controlled by means of outputs from the OR-gates OR1 and OR2, respectively. In this case, the clock pulse signals corresponds to the envelope information values E1 and E2.

As a substitute for the two sets of key switches for sensing key operating speed, a well known sensor may be used, which is given in the form of a combination of a coil with magnet. In this instance, the voltage generated by the coil depending on the key depressing speed is converted into time signal by first converting the voltage into frequency signals and second counting such frequency signals by a counter. At a timing after starting of key depressing by such a converted time signal, switching of the envelope information values is effected.

In the case of the above-described embodiment, each envelope wave shape signal EV taken from the envelope wave shape memory 11 is used for control of the tone volume of each corresponding musical tone wave shape signal MW taken from the wave shape memory 4. In connection with this, however, the wave shape signal EV is usable for tone colour and tonal pitch control of the musical shape signal MW.

As is clear from the foregoing description, the present invention enables generation of an envelope wave shape signal having rise and/or fall of a pattern which varies in accordance with key operating speed, thereby greatly enriching function of an electronic musical instrument.

We claim:

1. An envelope waveshape generator for an electronic musical instrument having a keyboard including a plurality of keys comprising:

control means for generating a control signal responsive to the speed of depression or release of a key operation; and envelope waveshape address generating means connected to said control means for receipt of said control signal for generating an envelope waveshape address having at least two linear portions of different slopes in which an amplitude value of said envelope waveshape address progresses timewise from a first value to a second value without reverse progression, and for changing the slope of one of said portions relative to the other of said portions at least once in response to said control signal, said amplitude value of said envelope waveshape address at a point where said slope changes being different from said second value.

2. An envelope waveshape generator as claimed in claim 1 further comprising:

memory means connected to said envelope address generating means for storing an envelope waveshape and for generating said envelope waveshape upon receipt of said envelope waveshape address.

3. An envelope waveshape generator as claimed in claim 2 wherein said envelope waveshape address generating means comprises:

slope data generating means for generating slope data whose values vary in response to said control signal; and accumulating means for accumulating said slope data to produce said envelope waveshape address.

4. An envelope waveshape generator as claimed in claim 3 in which said slope data generating means generates first and second slope date different from each other; and said slope data generating means passes to said accumulating means, said first slope data in response to a first signal generated when key depression starts, and said second slope data in response to a second signal generated when key depression has reached an intermediate extent of depression between no depression and full depression.

5. An envelope waveshape generator as claimed in claim 3 in which said slope data generating means generates first and second slope data different from each other; and said slope data generating means passes to said accumulating means, said first slope data in response to a first signal generated when key release starts, and said second slope data in response to a second signal generated when key release has been completed.

6. An envelope waveshape generator as claimed in claim 3 in which independent slope data is stored for each key in said keyboard.

7. An envelope waveshape generator as claimed in claim 3 in which said slope data generating means includes, in parallel, at least two memories for storing said slope data.

8. An envelope waveshape generator as claimed in claim 3 in which said slope data is multi-bit, and said slope data generating means includes:

a memory for storing said slope data;

a shifter connected to said memory; and operating means for executing instructions from among certain bits of said envelope waveshape address including shifting of said slope data, non-shifting of said slope data and inhibiting of said slope data in response to said control signal.

9. An electronic musical instrument comprising:

keyboard means having a plurality of keys;

tone signal generating means for generating a tone signal corresponding to a depressed key in said keyboard means;

control means for generating a control signal in response to the speed of key depression;

envelope waveshape generating means responsive to said control signal for generating an envelope waveshape whose amplitude value progresses timewise from a first to second value without reverse progression and for producing, during the progression, a salient point in an attack portion of said envelope waveshape, the timewise position of said salient point being determined by said control signal, the amplitude value of said envelope waveshape at said salient point being different from both of said first and second values; and envelope imparting means for imparting said envelope waveshape to said tone signal generated by said tone signal generating means.

10. An electronic musical instrument comprising:

keyboard means having a plurality of keys;

tone signal generating means for generating a tone signal corresponding to a depressed key in said keyboard means;

control means for generating a control signal in response to the speed of key release;

envelope waveshape generating means responsive to said control signal for generating an envelope waveshape whose amplitude value progresses timewise from a first to second value without reverse progression and for producing, during the progression, a salient point in a decay portion of said envelope waveshape, the timewise position of said salient point being determined by said control signal, the amplitude value of said envelope waveshape at said salient point being different from both of said first and second values; and envelope imparting means for imparting said envelope waveshape to said tone signal generated by said tone signal generating means.

11. An electronic musical instrument as claimed in claim 9 or 10, in which said envelope waveshape generating means comprises:

an envelope information generator for generating envelope information having at least two linear portions of different slopes in response to said control signal; and envelope waveshape generator for generating said envelope waveshape in response to said envelope information, said salient point corresponding to the point at which said two linear portions are connected to each other.

* * * * *

UNITED STATES PATENT AND TRADEMARK OFFICE

CERTIFICATE OF CORRECTION

PATENT NO. : 4,440,056

DATED : April 3, 1984

INVENTOR(S) : KOZUKI et al.

It is certified that error appears in the above-identified patent and that said Letters Patent are hereby corrected as shown below:

Column 6, line 36, after "with" insert --a--.

Column 7, line 17, delete "2" and substitute therefor --1--.

Signed and Sealed this

*Sixteenth* Day of *October 1984*

[SEAL]

*Attest:*

GERALD J. MOSSINGHOFF

*Attesting Officer*

*Commissioner of Patents and Trademarks*